US009016401B2

(12) United States Patent
Savage et al.

(10) Patent No.: US 9,016,401 B2
(45) Date of Patent: Apr. 28, 2015

(54) MODULAR ROTARY STEERABLE ACTUATORS, STEERING TOOLS, AND ROTARY STEERABLE DRILLING SYSTEMS WITH MODULAR ACTUATORS

(75) Inventors: John Keith Savage, Edmonton (CA); Kennedy John Kirkhope, Leduc (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/007,192

(22) PCT Filed: Jun. 12, 2012

(86) PCT No.: PCT/US2012/042069

§ 371 (c)(1),
(2), (4) Date: Jan. 2, 2014

(87) PCT Pub. No.: WO2013/187885

PCT Pub. Date: Dec. 19, 2013

(65) Prior Publication Data

US 2014/0110178 A1 Apr. 24, 2014

(51) Int. Cl.

| | |
|---|---|
| ***E21B 7/08*** | (2006.01) |
| ***E21B 7/06*** | (2006.01) |
| ***E21B 7/04*** | (2006.01) |
| ***E21B 47/02*** | (2006.01) |
| ***E21B 4/02*** | (2006.01) |

(52) U.S. Cl.
CPC ... *E21B 7/06* (2013.01); *E21B 7/04* (2013.01); *E21B 47/02* (2013.01); *E21B 4/02* (2013.01)

(58) Field of Classification Search
CPC ..... E21B 7/067; E21B 7/068
USPC ..... 175/61, 62, 73, 74, 76
See application file for complete search history.

(56) References Cited

U.S. PATENT DOCUMENTS

| | | | | |
|---|---|---|---|---|
| 3,743,034 | A * | 7/1973 | Bradley | 175/61 |
| 5,139,094 | A | 8/1992 | Prevedel et al. | |
| 5,314,030 | A | 5/1994 | Peterson et al. | |
| 5,706,905 | A | 1/1998 | Barr | |
| 5,803,185 | A | 9/1998 | Barr et al. | |
| 6,244,361 | B1 | 6/2001 | Comeau et al. | |
| 6,427,783 | B2 | 8/2002 | Krueger et al. | |

(Continued)

OTHER PUBLICATIONS

International Search Report and Written Opinion mailed Jul. 24, 2013 which issued in corresponding International Patent Application No. PCT/US2012/042069 (10 pages).

*Primary Examiner* — David Bagnell
*Assistant Examiner* — Ronald Runyan
(74) *Attorney, Agent, or Firm* — Chamberlain Hrdlicka

(57) ABSTRACT

Modular actuators, steering tools, and rotary steerable drilling systems are presented herein. A modular actuator is disclosed for use in directing a drill string, which includes a housing proximate a drive shaft. The modular actuator includes a cartridge that is configured to couple to the outer periphery of the housing. A fluid reservoir is contained within the cartridge. A hydraulically actuated actuator piston, which is slidably disposed at least partially inside the cartridge, is movable between activated and deactivated positions. A hydraulic control system is also contained within the cartridge, fluidly coupling the fluid reservoir to the actuator piston. The hydraulic control system is configured to regulate movement of the actuator piston between the activated and deactivated positions such that the actuator piston selectively presses against and moves the drive shaft and thereby changes the direction of the drill string.

20 Claims, 6 Drawing Sheets

(56) References Cited

U.S. PATENT DOCUMENTS

| | | | |
|---|---|---|---|
| 6,761,232 | B2 | 7/2004 | Moody et al. |
| 6,769,499 | B2 | 8/2004 | Cargill et al. |
| 6,837,314 | B2 | 1/2005 | Krueger et al. |
| 6,913,095 | B2 | 7/2005 | Krueger |
| 7,106,210 | B2 | 9/2006 | Golla et al. |
| 7,267,184 | B2 | 9/2007 | Helms et al. |
| 7,413,034 | B2 | 8/2008 | Kirkhope et al. |
| 7,685,732 | B2 | 3/2010 | Davies et al. |
| 2004/0231893 | A1 | 11/2004 | Kent |
| 2007/0235227 | A1 | 10/2007 | Kirkhope et al. |
| 2010/0025115 | A1 | 2/2010 | Kotsonis et al. |
| 2010/0259415 | A1 | 10/2010 | Strachan et al. |
| 2011/0031023 | A1 | 2/2011 | Menezes et al. |
| 2011/0139513 | A1 | 6/2011 | Downton |
| 2012/0018225 | A1 | 1/2012 | Peter et al. |

* cited by examiner

MODULAR ROTARY STEERABLE ACTUATORS, STEERING TOOLS, AND ROTARY STEERABLE DRILLING SYSTEMS WITH MODULAR ACTUATORS

CROSS-REFERENCE TO RELATED APPLICATIONS

This application is a U.S. national stage of International Patent Application No. PCT/US2012/042069, filed Jun. 12, 2012, the contents of which are incorporated herein by reference in its entirety.

TECHNICAL FIELD

The present disclosure relates generally to the drilling of boreholes, for example, during hydrocarbon exploration and excavation. More particularly, the present disclosure relates to steering apparatuses and steering actuators for directing drilling assemblies.

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit, and BHA—can be referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Directional drilling typically requires controlling and varying the direction of the wellbore as it is being drilled. Oftentimes the goal of directional drilling is to reach a position within a target subterranean destination or formation with the drill string. For instance, the drilling direction may be controlled to direct the wellbore towards a desired target destination, to control the wellbore horizontally to maintain it within a desired payzone, or to correct for unwanted or undesired deviations from a desired or predetermined path. Frequent adjustments to the direction of the wellbore are often necessary during a drilling operation, either to accommodate a planned change in direction or to compensate for unintended or unwanted deflection of the wellbore. Unwanted deflection may result from a variety of factors, including the characteristics of the formation being drilled, the makeup of the bottomhole drilling assembly, and the manner in which the wellbore is being drilled, as some non-limiting examples.

Various options are available for providing steering capabilities to a drilling tool for controlling and varying the direction of the wellbore. In directional drilling applications, for example, one option is to attach a bent-housing or a bent-sub downhole drilling motor to the end of the drilling string as a steering tool. When steering is required, the drill-pipe section of the drilling string can be restrained against rotation and the drilling motor can be pointed in a desired direction and operated for both drilling and steering in a "sliding drilling" mode. When steering is not required, the drilling string and the drilling motor can be rotated together in a "rotary drilling" mode. An advantage to this option is its relative simplicity. One disadvantage to this option, however, is that steering is typically limited to the sliding drilling mode. In addition, the straightness of the borehole in rotary drilling mode may be compromised by the presence of the bent drilling motor. Furthermore, since the drill pipe string is not rotated during sliding drilling, it is more susceptible to sticking in the wellbore, particularly as the angle of deflection of the wellbore from the vertical increases, resulting in reduced rates of penetration.

Directional drilling may also be accomplished with a "rotary steerable" drilling system wherein the entire drill pipe string is rotated from the surface, which in turn rotates the bottomhole assembly, including the drilling bit, connected to the end of the drill pipe string. In a rotary steerable drilling system, the drilling string may be rotated while the drilling tool is being steered either by being pointed or pushed in a desired direction (directly or indirectly) by a steering device. Some rotary steerable drilling systems include a component which is non-rotating relative to the drilling string in order to provide a reference point for the desired direction and a mounting location for the steering device(s). Alternatively, a rotary steerable drilling system may be "fully rotating". Some advantages to rotary steerable drilling systems are that they can provide relatively high steering accuracy and they need not be operated in a sliding drilling mode to provide steering capabilities. In addition, the rate of penetration tends to be greater, while the wear of the drilling bit and casing are often reduced. However, rotary steerable drilling systems are relatively complex apparatuses and tend to be more expensive than their conventional counterparts.

As a third option, directional drilling may be accomplished using a combination of both rotary steerable drilling and sliding drilling. Rotary steerable drilling will typically be performed until such time that a variation or change in the direction of the wellbore is desired. At this point, rotation of the drill pipe string is stopped and sliding drilling, through use of the downhole motor, is commenced. Although the use of a combination of sliding and rotary drilling may permit satisfactory control over the direction of the wellbore, many of the problems and disadvantages associated with sliding drilling are still encountered.

Various attempts have been made to provide rotary steerable drilling systems which address these problems. Numerous examples of prior art rotary steerable drilling apparatuses are disclosed in U.S. Pat. No. 6,769,499, to Edward J. Cargill et al., and U.S. Pat. No. 7,413,034, to Kennedy Kirkhope, both of which are incorporated herein by reference in their respective entireties and for all purposes. In many of these disclosed configurations, however, servicing the individual actuators often requires opening the steering tool, which is typically a very complicated and time consuming process. Exposing the internal hydraulics of the steering system is also generally not desirable due to environmental corrosion and other deleterious effects. In addition, once replaced, each of the actuators must then be tested at the rig site to ensure proper functionality, which adds to downtime and repair costs. There remains a need for improved and simplified rotary steerable drilling configurations which reduce servicing costs and down time, simplify installment and testing, and minimize environmental exposure of the tool.

SUMMARY

Aspects of the present disclosure are directed to modular rotary steerable actuators which package all of the components necessary to provide the functionality of a steering actuator into a single cartridge that is mounted to the exterior of the steering tool. In some configurations, the modular actuator is a self-contained apparatus with a pump, a fluid reservoir, a pressure compensator piston, a solenoid control valve, and an actuator piston, all of which are packaged in a common housing. By limiting external connections to electrical control logic, the modular actuator can reduce leak points and permits oil filling and verification of "on the shelf" cartridges. The foregoing configuration also allows for ease of replacement of the individual actuators from outside the steering tool with only electrical control and positional feedback connections. The modular actuator also provides the benefits and capabilities of a hydraulic actuator without the "at rig" servicing complications often associated with prior art directional steering systems. Another advantage is the ability to stock complete replacement actuator cartridges that quickly and easily replace onboard cartridges to rapidly return the steering tool to downhole readiness. Isolating the hydraulic circuits also help to simplify differing system pressures. Another advantage is the ability to use more of the common cartridges to scale into larger tools.

Some embodiments of the present disclosure are directed to a steering tool for use in drilling a borehole. The steering tool may be used, for example, for drilling vertical and/or non-vertical boreholes. The steering tool is a hydro-mechanical tool with a plurality of self-contained, separately actuable, circumferentially spaced modular actuators. The steering tool is intended to be incorporated into a drill string. The steering tool may be incorporated into a drill string in several different configurations depending, for example, on the intended drilling application. In some configurations, the steering tool is configured as a component of a drilling motor. The steering tool can also be adapted as a component of a rotary steerable drilling system. In some configurations, the steering tool is adapted as a component of a fully rotating rotary steerable drilling system.

Aspects of the present disclosure are directed to a modular actuator for use in directing a drill string, which includes a housing and a drive shaft. The modular actuator includes a cartridge that is configured to couple to the outer periphery of the drill string housing. A fluid reservoir is contained within the cartridge. A hydraulically actuated actuator piston, which is slidably disposed at least partially inside the cartridge, is movable between first and second positions. A hydraulic control system is also contained within the cartridge, fluidly coupling the fluid reservoir to the actuator piston. The hydraulic control system is configured to regulate movement of the actuator piston between the first and second positions such that the actuator piston selectively moves the drive shaft and thereby changes the direction of the drill string.

According to other aspects of the present disclosure, a steering tool is presented for use in directing a drill string when drilling a borehole in an earth formation. The drill string includes a drive shaft and a swash plate. The steering tool includes a tubular housing with an exterior surface and a housing bore configured to receive therethrough the drive shaft. The steering tool also includes a plurality of modular actuators circumferentially spaced about the exterior surface of the housing. Each of the modular actuators includes: a cartridge coupled to the exterior surface of the housing; a fluid reservoir sealed within the cartridge; a hydraulically actuated actuator piston slidably disposed at least partially inside the cartridge, the actuator piston being movable between deactivated and activated positions; and, a hydraulic control system sealed within the cartridge and fluidly coupling the fluid reservoir to the actuator piston. The hydraulic control system is configured to regulate the movement of the actuator piston between the deactivated and activated positions such that the actuator piston selectively moves the drive shaft and thereby changes the direction of the drill string.

A rotary steerable drilling system is also featured in accordance with aspects of this disclosure. The rotary steerable drilling system includes a drill-pipe string and a tubular housing operatively coupled to a distal end of the drill-pipe string. The tubular housing has an exterior surface and a housing bore. A drive shaft, which extends through the tubular housing, includes a plurality of ramped surfaces. A drill bit is rotatably coupled to the tubular housing via the drive shaft. The rotary steerable drilling system also includes a steering controller and a plurality of modular actuators circumferentially spaced about the exterior surface of the housing. Each of the modular actuators includes: a cartridge coupled to the exterior surface of the housing; an electrical connector electrically connecting the modular actuator with the steering controller; a fluid reservoir sealed within the cartridge; a hydraulically actuated actuator piston slidably disposed at least partially inside the cartridge, the piston being movable between deactivated and activated positions; and, a hydraulic control system sealed within the cartridge and fluidly coupling the fluid reservoir to the actuator piston. The hydraulic control system is configured to regulate movement of the actuator piston from the deactivated position to the activated position such that the actuator piston selectively presses against one of the ramped surfaces of the drive shaft and thereby changes the direction of the drill string.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
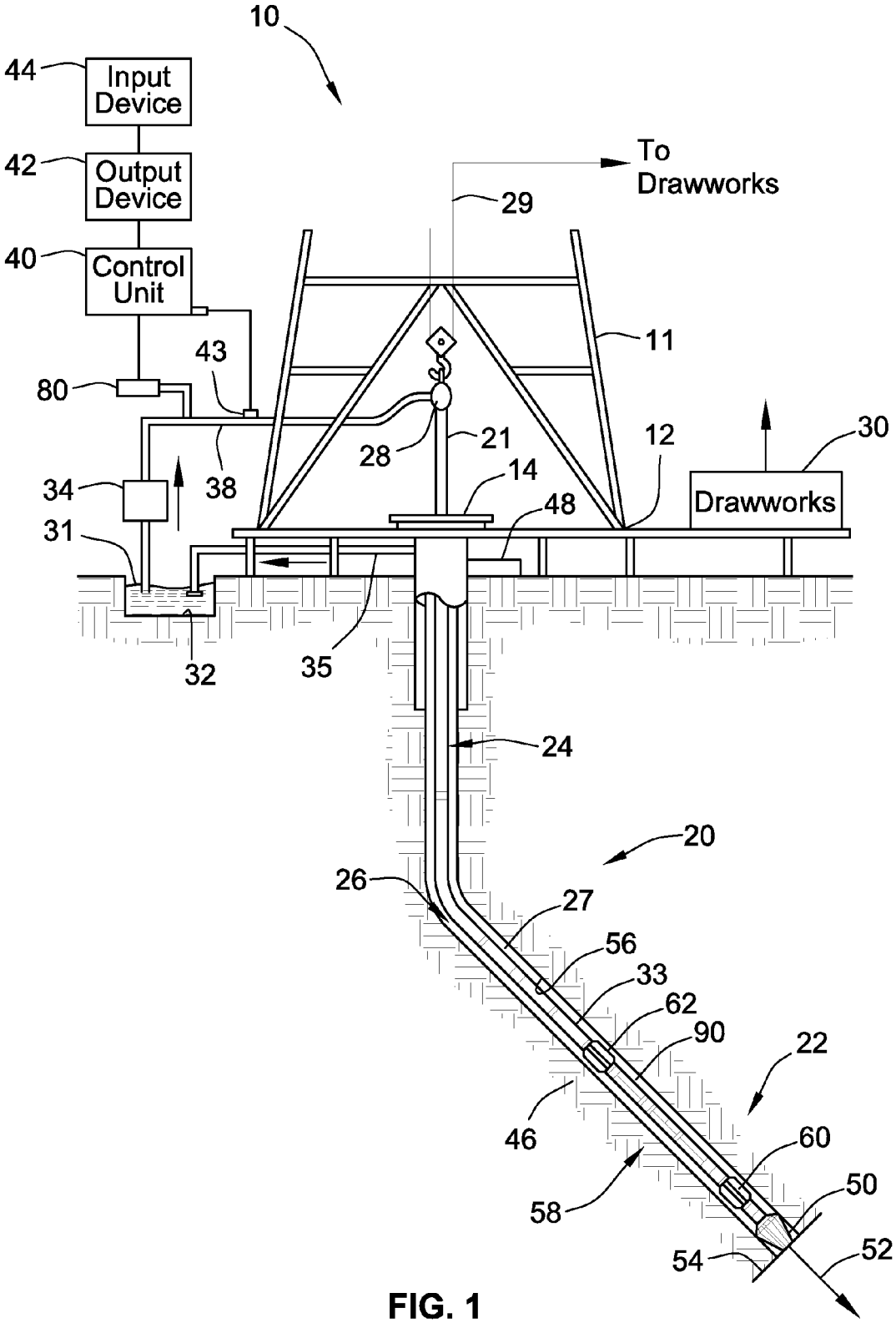
FIG. 1 is a schematic illustration of an exemplary drilling system in accordance with aspects of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

While this invention is susceptible of embodiment in many different forms, there are shown in the drawings and will herein be described in detail embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed, the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of;" or "within acceptable manufacturing tolerances," or any logical combination thereof, for example.

Referring now to the drawings, wherein like reference numerals refer to like components throughout the several views, FIG. 1 illustrates an exemplary directional drilling system, designated generally as 10, in accordance with aspects of the present disclosure. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIGS. 1 and 2. For example, many of the features and aspects presented herein can be applied in horizontal drilling applications and vertical drilling applications without departing from the intended scope and spirit of the present disclosure. In addition, it should be understood that the drawings are not necessarily to scale and are provided purely for descriptive purposes; thus, the individual and relative dimensions and orientations presented in the drawings are not to be considered limiting. Additional information relating to directional drilling systems can be found, for example, in U.S. Patent Application Publication No. 2010/0259415 A1, to Michael Strachan et al., which is entitled "Method and System for Predicting Performance of a Drilling System Having Multiple Cutting Structures" and is incorporated herein by reference in its entirety for all purposes.

The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid (commonly referred to in the art as "mud") 31 can be circulated, under pressure, out from a mud pit 32 and into the borehole 26 through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side 56 of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc., which will be explained in further detail below.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Exemplary methods and apparatuses for mud pulse telemetry are described in U.S. Pat. No. 7,106,210 B2, to Christopher A. Golla et al., which is incorporated herein by reference in its entirety. Other known methods of telemetry which may be used without departing from the intended scope of this disclosure include electromagnetic telemetry, acoustic telemetry, and wired drill pipe telemetry, among others.

A transducer 43 can be placed in the mud supply line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 80 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 can provide some or all of the requisite force for the bit 50 to break through the formation 46 (known as "weight on bit"), and provide the necessary directional control for drilling the borehole 26. In the embodiments illustrated in FIGS. 1 and 2, the BHA 22 may comprise a drilling motor 90 and first and second longitudinally spaced stabilizers 60 and 62. At least one of the stabilizers 60, 62 may be an adjustable stabilizer that is operable to assist in controlling the direction of the borehole 26. Optional radially adjustable stabilizers may be used in the BHA 22 of the steerable directional drilling system 10 to adjust the angle of the BHA 22 with respect to the axis of the borehole 26. A radially adjustable stabilizer provides a wider range of directional adjustability than is available with a conventional fixed diameter stabilizer. This adjustability may save substantial rig time by allowing the BHA 22 to be adjusted downhole instead of tripping out for changes. However, even a radially adjustable stabilizer provides only a limited range of directional adjustments. Additional information regarding adjustable stabilizers and their use in directional drilling systems can be found in U.S. Patent Application Publication No. 2011/0031023 A1, to Clive D. Menezes et al., which is entitled "Borehole Drilling Apparatus, Systems, and Methods" and is incorporated herein by reference in its entirety.

Figure 2:
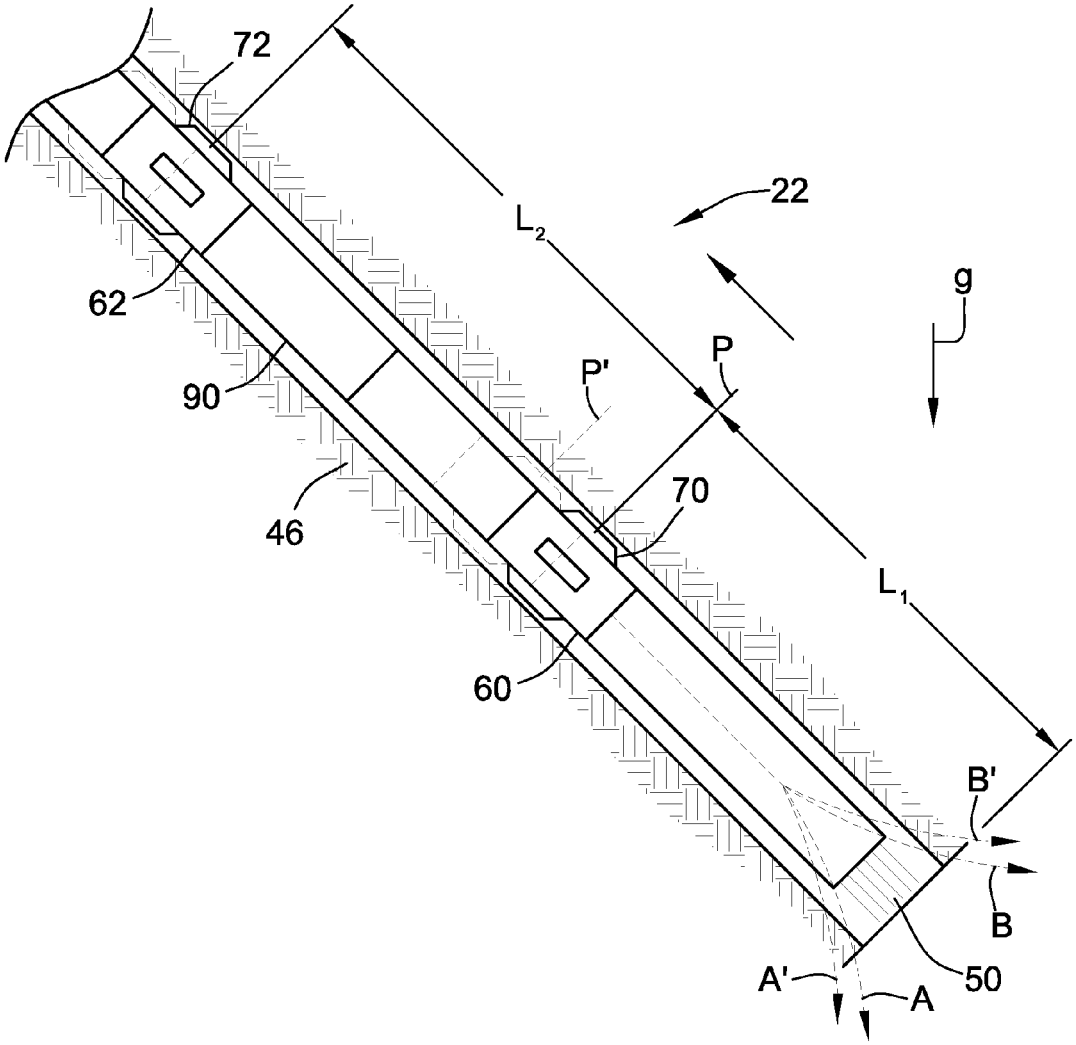
FIG. 2 is a schematic illustration of an exemplary bottom hole assembly (BHA) in accordance with aspects of the present disclosure.

As shown in the embodiment of FIG. 2, the distance between the drill bit 50 and the first stabilizer 60, designated as $L_1$, can be a factor in determining the bend characteristics of the BHA 22. Similarly, the distance between the first stabilizer 60 and the second stabilizer 62, designated as $L_2$, can be another factor in determining the bend characteristics of the BHA 22. The deflection at the drill bit 50 of the BHA 22 is a nonlinear function of the distance $L_1$, such that relatively small changes in $L_1$ may significantly alter the bending characteristics of the BHA 22. With radially movable stabilizer blades, a dropping or building angle, for example A or B, can be induced at bit 50 with the stabilizer at position P. By axially moving stabilizer 60 from P to P', the deflection at bit 50 can be increased from A to A' or B to B'. A stabilizer having both axial and radial adjustment may substantially extend the range of directional adjustment, thereby saving the time necessary to change out the BHA 22 to a different configuration. In some embodiments the stabilizer may be axially movable. The position and adjustment of the second stabilizer 62 adds additional flexibility in adjusting the BHA 22 to achieve the desired bend of the BHA 22 to achieve the desired borehole curvature and direction. As such, the second stabilizer 62 may have the same functionality as the first stabilizer 60. While shown in two dimensions, proper adjustment of stabilizer blades may also provide three dimensional turning of BHA 22.

Figure 3:
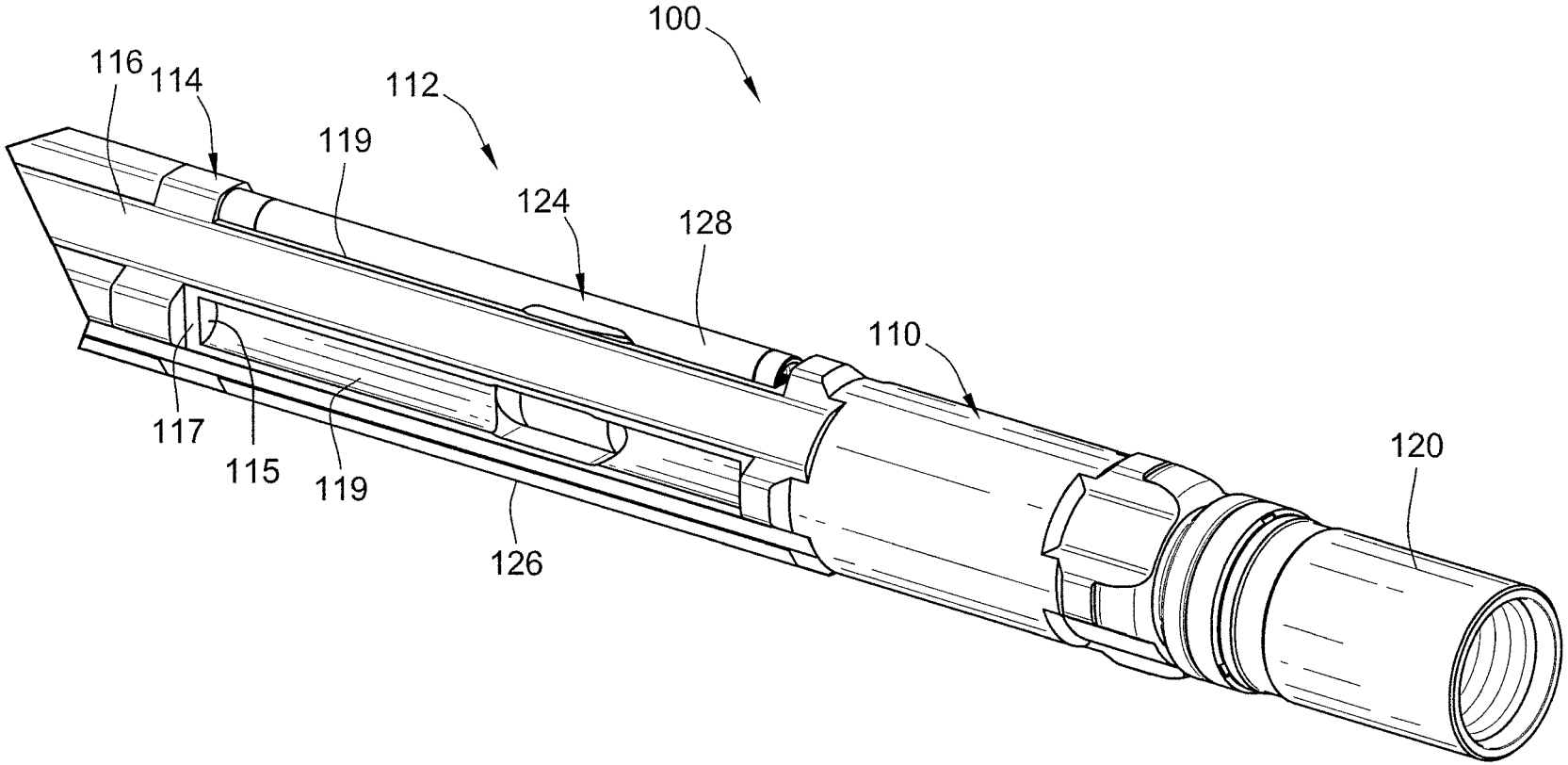
FIG. 3 is a perspective view illustration of a representative rotary steering tool assembly with a cover portion removed to show an externally mounted modular rotary steerable actuator in accordance with aspects of the present disclosure.

FIG. 3 illustrates a portion of a drill string system 100 of the type used for drilling a borehole in an earth formation. The drill string system 100 of FIG. 3 is represented by a bottom hole assembly (BHA) 110 and a rotary steering tool assembly, designated generally at 112. The drill string system 100 of FIG. 3 can take on various forms, optional configurations, and functional alternatives, including those described above with respect to the directional drilling system 10 exemplified in FIGS. 1 and 2, and thus can include any of the corresponding options and features. Moreover, only selected components of the drill string system 100 have been shown and will be described in additional detail hereinbelow. Nevertheless, the drill string systems discussed herein, including the corresponding BHA and steering tool configurations, can include numerous additional, alternative, and other well-known peripheral components without departing from the intended scope and spirit of the present disclosure. Seeing as these components are well known in the art, they will not be described in further detail.

Figure 4:
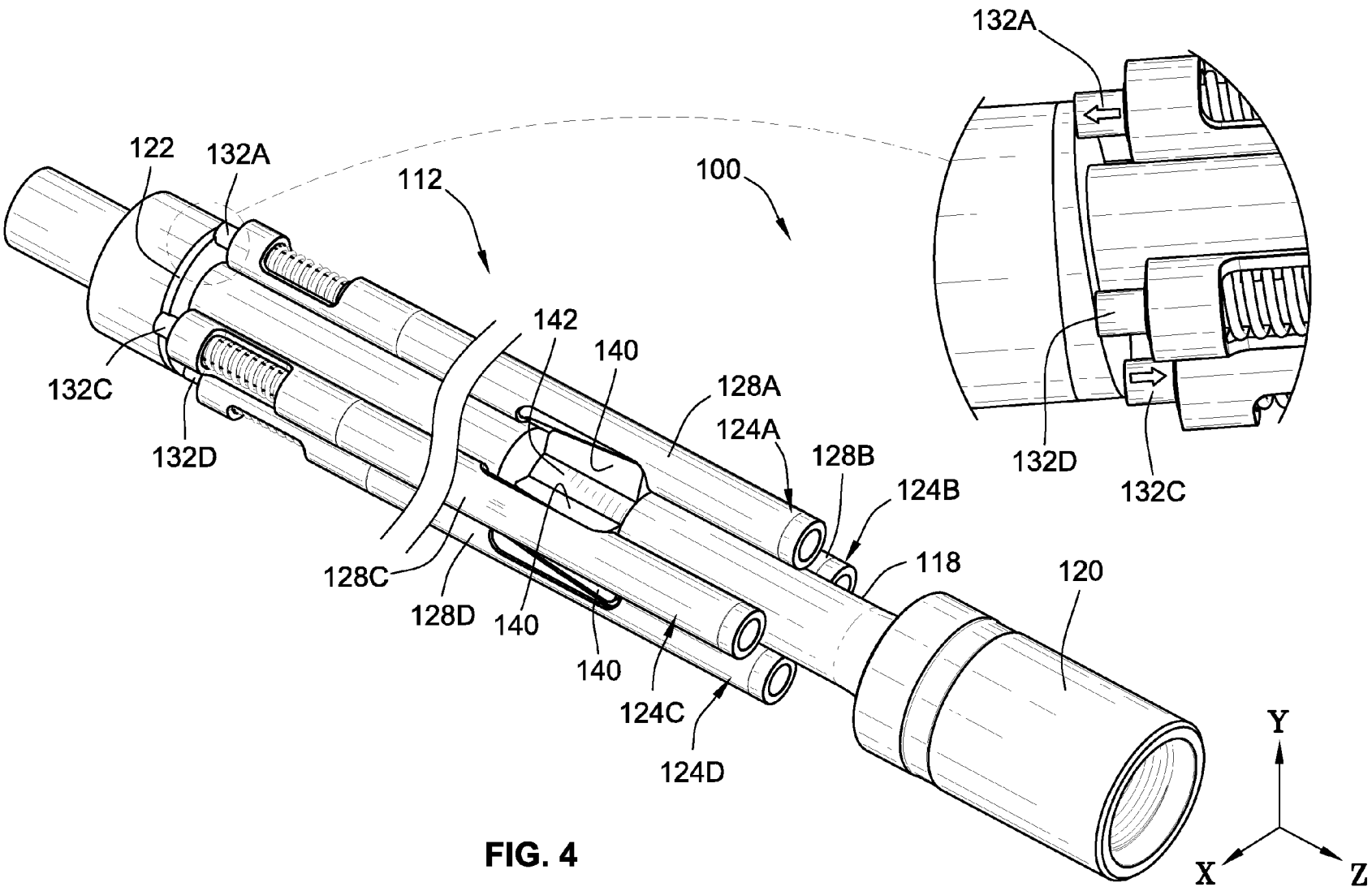
FIG. 4 is another perspective view illustration of the representative rotary steering tool assembly of FIG. 3 with portions of the outer housing removed to show four circumferentially spaced modular actuators.

In the embodiment illustrated in FIG. 3, the steering tool 112 is configured as part of a drilling motor 114 having a motor housing 116 and a motor drive shaft 118 (FIG. 4; also referred to herein as "drive shaft"). In this instance, the steering tool 112 chassis is part of the drivetrain into which the actuator steering mechanism and electronics packages (e.g., steering controller 160 of FIG. 7) would mount. It is also conceivable that the steering mechanism and electronics could be made entirely replaceable from outside the steering tool 112 with the tool chassis providing the requisite mechanical support. Alternatively, the steering tool 112 can be configured as a component of a rotary steerable drilling system of the type in which the steering tool 112 is rotatably connected with the drill string. In this configuration, the housing 116 would be part of the steering tool 112, which could be outfitted with an optional borehole engaging device for inhibiting the steering tool 112 from rotating when the drill string is rotated. Optionally, the steering tool 112 can be configured as a component of a fully rotating rotary steerable drilling system, which may be of the type in which the steering tool 112 is fixedly connected within the drill string.

A rotatable drill bit (e.g., drill bit 50 of FIG. 1) is located at a distal end of the drill string system 100, projecting from the elongated, tubular housing 116 of FIG. 3. The tubular housing 116 is operatively attached or otherwise coupled, e.g., via a top sub (not shown), to the distal end of a drill pipe or drill-pipe string (e.g., which could be a portion of the drill pipe section 24 of FIG. 1). A bottom (or "bit") sub 120 couples the drive shaft 118 of the mud motor assembly 114 to a drill bit. By using a Measurement While Drilling (MWD) Tool, such as MWD 58 of FIG. 1, a directional driller can steer the bit to a desired target zone. As seen in FIG. 4, a swash plate 122 is mounted at an angle on drive shaft 118, proximate to the housing 116. The swash plate 122 is operable to draw mechanical power from the driveshaft 118 to help create hydraulic power for the modular actuators 124A-D, as will be developed in further detail below.

The motor assembly 114 of FIG. 3 can be a positive displacement motor (PDM) assembly, which may be in the nature of SperryDrill® or SperryDrill® XL/XLS series positive displacement motor assemblies available from Halliburton of Houston, Tex. In this instance, the PDM motor assembly 114 includes a multi-lobed stator (not shown) with an internal passage within which is disposed a multi-lobed rotor (not shown). The PDM assembly 114 operates according to the Moineau principle—essentially, when pressurized fluid is forced into the PDM assembly and through the series of helically shaped channels formed between the stator and rotor, the pressurized fluid acts against the rotor causing nutation and rotation of the rotor within the stator. Rotation of the rotor generates a rotational drive force for the drill bit, as will be developed in further detail below.

The distal end of the rotor is coupled to the rotatable drill bit via the drive shaft 118 and bit sub 120 such that the eccentric power from the rotor is transmitted as concentric power to the bit. In this manner, the PDM motor assembly 114 can provide a drive mechanism for the drill bit which is at least partially and, in some instances, completely independent of any rotational motion of the drill string generated, for example, via rotation of a top drive in the derrick mast and/or the rotary table 14 on the derrick floor 12 of FIG. 1. Directional drilling may also be performed by rotating the drill string 100 while contemporaneously powering the PDM assembly 114, thereby increasing the available torque and drill bit speed. The drill bit may take on various forms, including diamond-impregnated bits and specialized polycrystalline-diamond-compact (PDC) bit designs, such as the FX and FS Series™ drill bits available from Halliburton of Houston, Tex., for example.

An external surface 117 of the housing 116 shown in FIG. 3 defines a plurality elongated cavities 119 extending parallel to one another and longitudinally with respect to the drill string 100. In the illustrated embodiment, there are four cavities 119 in the housing 116, only two of which are visible in the drawings, but two more cavities are located on opposite sides of the housing 116 to the ones shown. Nested within each cavity 119 is a modular actuator 124 which is operable to direct the drill string 100 during a drilling operation, as will be developed in further detail below. As seen in FIG. 4, there are four modular actuators 124A, 124B, 124C and 124D circumferentially spaced equidistant from one another about the outer periphery of the housing 116. In at least some embodiments, all of the modular actuators 124A-D are structurally identical. An optional actuator shield 126 can be employed to cover and protect each of the modular actuators 124A-D. Although shown with four modular actuators 124A-D, the rotary steering tool assembly 112 can include greater or fewer than the number shown.

Figure 5:
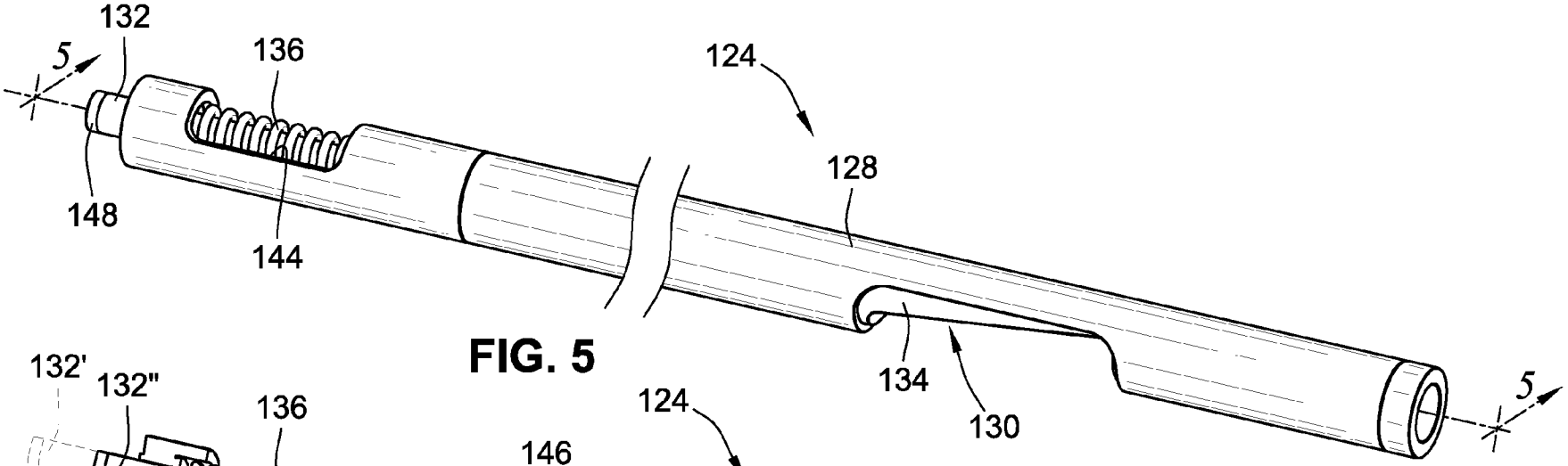
FIG. 5 is a perspective view illustration of an example of a modular rotary steerable actuator in accordance with aspects of the present disclosure.
Figure 6:
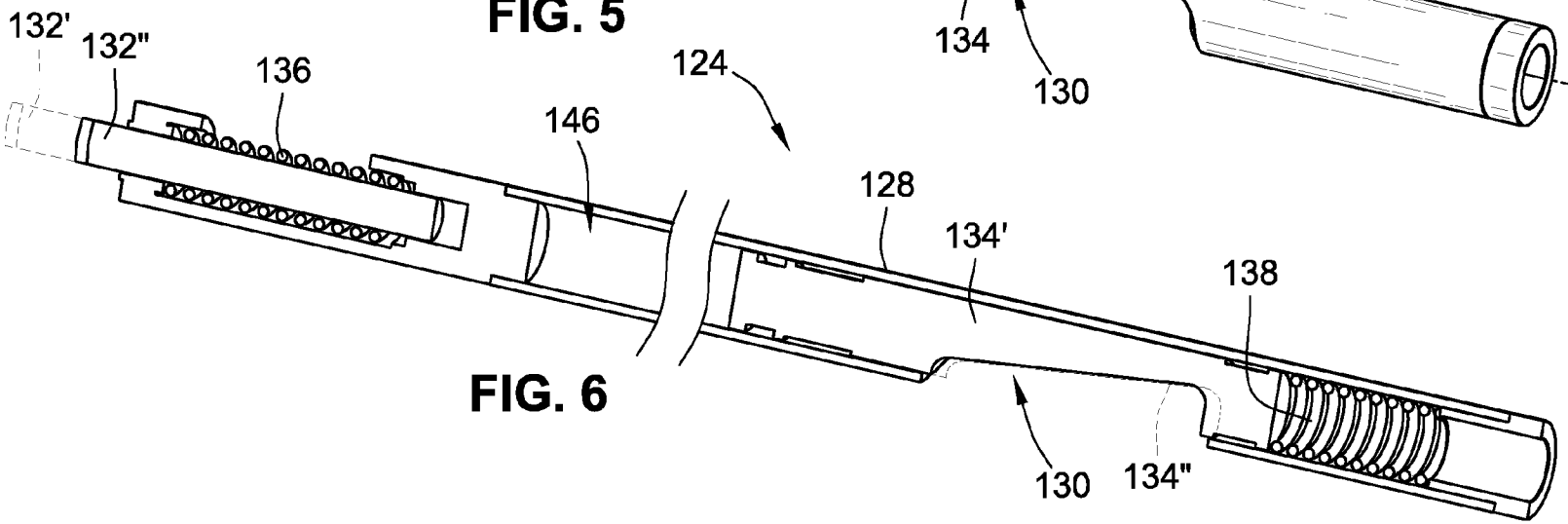
FIG. 6 is a cross-sectional perspective-view illustration of the modular rotary steerable actuator of FIG. 5 taken along line 5-5.

Each modular actuator 124A-D includes a respective cartridge 128A, 128B, 128C and 128D that is configured to couple to the outer periphery of the housing 116. As seen in FIGS. 5 and 6, for example, the cartridge 128 includes an elongated tubular body with a window 130 formed therethrough, and a pair of pistons 132 and 134 slidably disposed at least partially inside the cartridge 128. The first piston 132 (also referred to herein as "pump piston") projects out from an uphole longitudinal end of the elongated tubular body 128, whereas the second piston 134 (also referred to herein as "actuator piston") slides across and at least partially obstructs the window 130, e.g., when moving from a deactivated position to an activated position. The window 130 is designed to fit onto and receive therein a complementary shaft ramp 140 protruding radially outward from the drive shaft 118, which is best seen in FIG. 4. The shaft ramps 140 may be mounted onto the drive shaft 118 via a bearing 142. Additional attachment means may be employed for mechanically coupling each cartridge 128A-D to the housing 116 and/or drive shaft 118. It is desirable, in at least some embodiments, that the cartridges 128A-D be removably coupled to the housing 116, e.g., for ease of installation and serviceability.

In the illustrated example, the first piston 132 faces "uphole" and translates generally rectilinearly along a common axis with the second piston 134, which faces and translates generally rectilinearly "downhole." The pistons 132, 134 are movable from respective first "deactivated" positions (e.g., 132' and 134' in FIG. 6) to respective second "activated" positions (e.g., 132" and 134" in FIG. 6), and back. Each of the modular actuators 124A-D contacts a portion of the swash plate 122. For instance, the pump piston 132A of the first actuator 124A extends through a complementary housing window 115 in housing 116 and, as shown in FIG. 4, initially engages the top-most central portion of the swash plate 122. Likewise, the pump piston 132B of the second actuator 124B extends through a corresponding housing window 115 in housing 116 and initially engages the right-most portion of the swash plate 122, which is approximately 90-degrees clockwise from where the first actuator 124A contacts the swash plate 122. Moreover, the pump piston 132C of the third actuator 124C extends through a corresponding housing window 115 in housing 116 and, as shown in FIG. 4, initially engages the left-most portion of the swash plate 122, which is approximately 90-degrees counterclockwise from the first actuator 124A. Finally, the pump piston 132D of the fourth actuator 124D extends through a corresponding housing window 115 in housing 116, and is shown in FIG. 4 initially engaging the bottom-most central portion of the swash plate 122, which is approximately 180-degrees clockwise from where the first actuator 124A contacts the swash plate 122. An optional bushing 148, which is shown in one example as a cylindrical polymeric cap coupled to the distal end of the piston 132 proximate the swash plate 122, operates to distribute loading caused by the angle of the swash plate.

FIGS. 3 and 4 illustrate what may be considered a typical X-Y steering system. In accordance with some embodiments, a minimum of two modular actuators 124 per plane are required. By way of example, and not limitation, activation of the first modular actuator 124A urges or otherwise moves the actuator piston 134A downhole such that a ramped surface of the piston 134A presses downwardly against a respective one of the shaft ramps 140 thereby redirecting the drive shaft 118. The actuator piston of the opposing same-plane actuator, i.e., the fourth modular actuator 124D in this example, will contemporaneously retract through corresponding return springs. In so doing, the first modular actuator 124A operates to steer or otherwise direct the drive shaft 118 and, thus, the drill string system 100 vertically downward along the y-axis of FIG. 4. To steer or otherwise direct the drill string system 100 vertically upward along the y-axis of FIG. 4, the fourth modular actuator 124D is activated while the actuator piston of the first modular actuator 124A is allowed to retract. Steering or otherwise turning the drill string system 100 to starboard (e.g., towards the lower-left corner of FIG. 4) includes activation of the second modular actuator 124B while the actuator piston of the third modular actuator 124C is allowed to retract. Contrastingly, turning the drill string system 100 to port (e.g., towards the upper-right corner of FIG. 4) includes activation of the third modular actuator 124C while the actuator piston of the second modular actuator 124B is allowed to retract.

In applications where larger forces are required (e.g., for larger tools), the drill string system 100 can employ additional and/or larger modular actuators 124. For instance, larger forces can be acquired by use of additional modular actuators 124 that are slightly out of plane with the primary modular actuators 124 (e.g., the four shown in FIG. 4) and acting on additional shaft ramps 140. It is also contemplated to provide a rotary steering tool assembly 112 which employs fewer than four modular actuators 124 for directional steering capabilities. Direction of steering can be determined by pushing or moving the shaft into the desired direction of steer, as described above, or by bending the shaft between spherical supports in which case the actuators are operated to steer in the opposite direction to which you push.

A first return spring 136 biases the first piston 132 towards the deactivated position 132', whereas a second return spring 138 biases the second piston 134 towards the deactivated position 134'. The rotary steering tool assembly 112 can be a "normally open" design. By way of non-limiting example, the second return spring 138 biases the actuator piston 134 towards the deactivated position 134". In this optional configuration, when one of the modular actuators 124 is deactivated or otherwise rendered inoperable, the corresponding actuator piston 134 is biased away from the shaft ramp 140 and toward the deactivated position 134' via the return spring 138, and the ramped surface of the actuator piston 134 does not apply a steering force to the drive shaft 118 via the shaft ramp 140. With all of the deactivated modular actuators 128 being biased out of steering engagement with the drive shaft 118, the rotary steering tool assembly 112 is a normally open "fail safe" configuration, which helps to ensure that the steering system defaults into a straight ahead condition, for example, on failure of the steering electronics. The first return spring 136 is shown loaded into a side window 144 of the cartridge 128 installed outside of an internal oil environment 146 to maximize useable oil space inside the cartridge 128.

Figure 7:
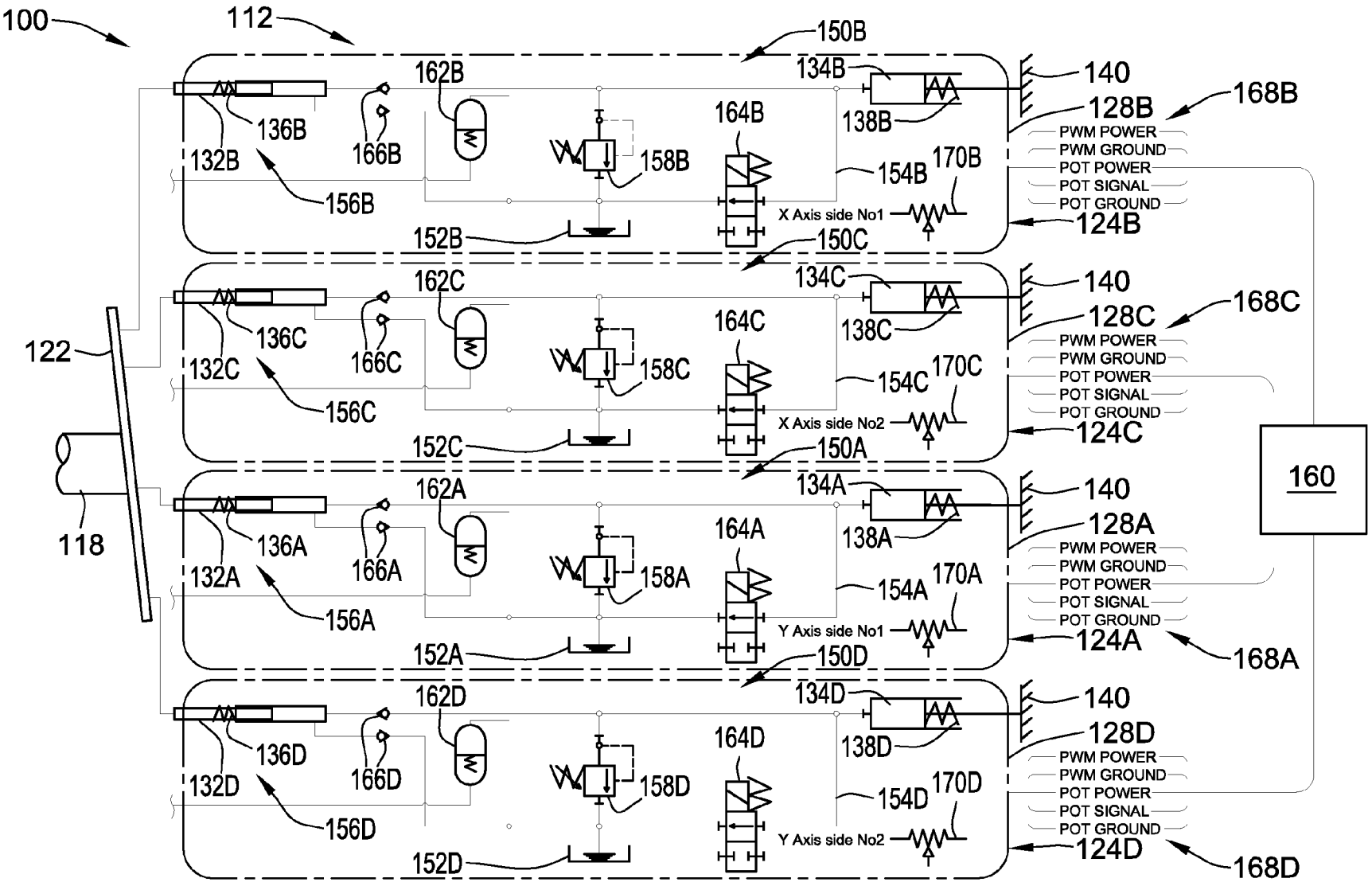
FIG. 7 is a schematic diagram of a four-axes modular rotary steerable actuator system in accordance with aspects of the present disclosure.

In accordance with aspects of the disclosed concepts, the individual modular actuators 124 each contains all the mechanical and hydraulic components necessary to operate as a hydraulic rotary steerable actuator, e.g., in a single plane. Turning to FIG. 7, for example, each of the modular actuators 124A-D includes a respective cartridge 128A-D from which project respective opposing pistons 132A-D and 134A-D. The first ("pump") pistons 132A-D project from respective longitudinal "uphole" ends of the cartridges 128A-D to selectively engage the swash plate 122, whereas the second pistons 134A-D are disposed at least partially inside the cartridges 128A-D and slidable to selectively press against a drive shaft 118 (e.g., via complementary shaft ramps 140) to displace the shaft 118 (e.g., directly or in bending) prompting a change of drilling direction. First return springs 136A-D bias the first pistons 132A-D towards deactivated positions, and second return springs 138A-D bias the second pistons 134A-D towards deactivated positions. Generally speaking, the modular actuators 124A-D of FIG. 5 can be structurally identical to one another and, in at least some embodiments, can take on any of the various forms, optional configurations, and functional alternatives described above with respect to the directional drilling system 100 exemplified in FIGS. 3 and 4 (and vice versa).

Hydraulic control systems, each of which is respectively designated at 150A, 150B, 150C and 150D in FIG. 7, is contained within and, in some embodiments, fluidly sealed inside each cartridge 128A-D. Also contained within and, in some embodiments, fluidly sealed inside the cartridge 128A-D is a fluid reservoir 152A-D (or "compensated oil volume"). The hydraulic control system 150A-150D fluidly couples the fluid reservoir 152A-D to the pistons 132A-D, 134A-D, and regulates the flow of fluid therebetween. In some non-limiting examples, each hydraulic control system 150A-150D of FIG. 7 includes hydraulic conduits 154A-D for fluidly connecting the individual components of the hydraulic control system 150A-150D and distributing hydraulic fluid therebetween. A pump 156A-D, which includes the pump piston 132A-C, is configured to move the fluid and thereby increase fluid pressure on the actuator piston 134A-C. Unidirectional inlet and exhaust valves 166A-D (e.g., poppet valves) are disposed between the pump pistons 132A-D and the fluid reservoirs 152A-D.

The hydraulic control systems 150A-150D are configured to regulate or otherwise control movement of the actuator pistons 134A-D between respective deactivated and activated positions to thereby change the direction of the drill string 100, for example, as described above with respect to FIGS. 3 and 4. According to the illustrated embodiment, each hydraulic control system 150A-150D includes a pressure relief valve 158A-D (e.g., regulated to a system maximum pressure), and an accumulator/compensator 162A-D configured to reduce or otherwise remove hydrostatic pressure. A pulse width modulation (PWM) valve assembly 164A-D, which may be in the nature of a PWM poppet valve metering configuration with high-to-low pressure bleed, can be employed to control fluid pressure on the actuator pistons 134A-D. PWM techniques can be employed to operate a single-acting solenoid valve controlled bleed to tank, and subsequently the system pressure and travel of the actuator pistons 134A-D. In alternative configurations, multi-way directional control valves or other known means can be employed to control fluid pressure. In at least some embodiments, the modular actuators 124A-D are characterized by a lack of a fluid coupling to the drill-pipe section of the drill string 100 to receive drilling fluid therefrom. In this vein, while all of the actuators 124A-D engage the drive shaft 118 for effectuating directional changes to the drill string 100, the hydraulic control systems 150A-D can be operated independently of each other.

The drill string system 100 further comprises an actuator steering mechanism and electronics packages, schematically represented herein by the steering controller (or "brain") 160 of FIG. 7. Each modular actuator 124A-D includes a respective electrical connector (or "cluster") 168A-D that receives signals for and/or transmits signals from the cartridge 128A-D. The electrical connectors 168A-D, which may include multi-socket electrical pigtail connectors, banded contacts, wireless communications, and/or other known connectors, operates to electrically couple the modular actuators 124A-D, namely the hydraulic control systems 150A-D, with the steering controller 160. By way of non-limiting example, each electrical connector 168A-D provides PWM POWER and PWM GROUND to the PWM valve assembly 164A-D, and also provides POT SIGNAL communication as well as POT POWER and POT GROUND to a positional sensor 170A-170C. The positional sensor may be in the nature of a linear potentiometer that is integrated into the cartridge 128A-D and configured relay or otherwise emit signals indicative of positional feedback data associated with the drill string 100.

Packaging each of the components necessary to effect a complete actuator into a single cartridge and utilizing an external "brain" to electrically control the status of the actuator provides a number of benefits over prior art rotary steerable systems. For instance, at least some of the configurations disclosed herein permit service of the hydraulic steering system at the rig site without having to expose the actuator hydraulics to the environment. The introduction of a new/replacement cartridge can quickly and easily return the function of the steering tool to "as new" condition. In addition, standardization of the cartridge can provide the opportunity for reduced inventory variety, optimization of the cartridge design, and the potential for a complete vendor-provided sealed package that is oil filled, tested, and ready to install.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A modular actuator for use in directing a drill string, the drill string having a housing and a drive shaft extending through the housing, the modular actuator comprising:

a cartridge configured to couple to the outer periphery of the housing adjacent the drive shaft;

a fluid reservoir contained within the cartridge;

an actuator piston slidably disposed at least partially inside the cartridge, the actuator piston being movable between first and second positions; and a hydraulic control system contained within the cartridge and fluidly coupling the fluid reservoir to the actuator piston, the hydraulic control system being configured to regulate movement of the actuator piston between the first and second positions such that the piston moves the drive shaft and thereby changes the direction of the drill string.

2. The modular actuator of claim 1, wherein the fluid reservoir and the hydraulic control system are fluidly sealed inside the cartridge.

3. The modular actuator of claim 1, wherein the drill string further comprises a steering controller, and wherein the modular actuator further comprises an electrical connector projecting from the cartridge and configured to electrically couple the hydraulic control system with the steering controller.

4. The modular actuator of claim 1, wherein the hydraulic control system includes a pulse width modulation valve assembly configured to control fluid pressure on the actuator piston.

5. The modular actuator of claim 1, wherein the hydraulic control system includes a compensator configured to reduce hydrostatic pressure on the actuator piston.

6. The modular actuator of claim 1, wherein the hydraulic control system includes a pressure relief valve.

7. The modular actuator of claim 1, wherein the hydraulic control system includes a pump configured to increase fluid pressure on the actuator piston.

8. The modular actuator of claim 7, wherein the drill string further comprises a swash plate proximate the housing, and wherein the pump includes a pump piston operatively engaged with and actuated by the swash plate.

9. The modular actuator of claim 8, wherein the cartridge includes an elongated tubular body, the pump piston projecting from a longitudinal end of the elongated tubular body.

10. The modular actuator of claim 8, further comprising a bushing operatively coupling the pump piston to the swash plate, the bushing being configured to distribute side loading caused by an angle of the swash plate.

11. The modular actuator of claim 1, further comprising a return spring configured to bias the actuator piston from the second position to the first position.

12. The modular actuator of claim 1, further comprising a position sensor contained within the cartridge and configured to generate signals indicative of positional feedback data associated with the position of the actuator piston.

13. The modular actuator of claim 1, characterized by a lack of a fluid coupling to a drill-pipe section of the drill string.

14. A steering tool for use in directing a drill string when drilling a borehole in an earth formation, the drill string including a drive shaft and a swash plate, the steering tool comprising:

a tubular housing having an exterior surface and defining a housing bore configured to receive therethrough the drive shaft;

a plurality of modular actuators circumferentially spaced about the exterior surface of the housing, each of the modular actuators including:

a cartridge coupled to the exterior surface of the housing;

a fluid reservoir sealed within the cartridge;

a hydraulically actuated actuator piston slidably disposed at least partially inside the cartridge, the actuator piston being movable between deactivated and activated positions; and a hydraulic control system sealed within the cartridge and fluidly coupling the fluid reservoir to the actuator piston, the hydraulic control system being configured to regulate movement of the actuator piston between the deactivated position and the activated position such that the actuator piston selectively moves the drive shaft and thereby changes the direction of the drill string.

15. The steering tool of claim 14, wherein the drill string further comprises a steering controller, and wherein each of the modular actuators further comprises an electrical connector projecting from the cartridge and configured to electrically connect the hydraulic control system with the steering controller.

16. The steering tool of claim 14, wherein each of the hydraulic control systems of each of the modular actuators includes:

a pump configured to increase fluid pressure on the actuator piston;

a pulse width modulation valve assembly configured to control fluid pressure on the actuator piston;

a pressure relief valve; and a compensator configured to reduce hydrostatic pressure on the actuator piston.

17. The steering tool of claim 14, wherein each of the cartridges includes a respective elongated tubular body extending longitudinally with respect to the tubular housing, the elongated tubular body defining a window across which the actuator piston slides when moving between the deactivated and activated positions.

18. The steering tool of claim 14, wherein each of the modular actuators is characterized by a lack of a fluid coupling to a drill-pipe section of the drill string.

19. The steering tool of claim 14, wherein the plurality of modular actuators includes at least four modular actuators circumferentially spaced equidistant from one another about the outer periphery of the housing, each of the at least four modular actuators contacting a distinct portion of the swash plate.

20. A rotary steerable drilling system comprising:

a drill-pipe string;

a tubular housing operatively coupled to a distal end of the drill-pipe string, the tubular housing having an exterior surface and defining a housing bore;

a drive shaft extending through the tubular housing, the drive shaft including a plurality of ramped surfaces;

a drill bit rotatably coupled to the tubular housing via the drive shaft;

a steering controller; and a plurality of modular actuators circumferentially spaced about the exterior surface of the housing, each of the modular actuators including:

a cartridge coupled to the exterior surface of the housing;

an electrical connector electrically connecting the modular actuator with the steering controller;

a fluid reservoir sealed within the cartridge;

a hydraulically actuated actuator piston slidably disposed at least partially inside the cartridge, the actuator piston being movable between deactivated and activated positions; and a hydraulic control system sealed within the cartridge and fluidly coupling the fluid reservoir to the actuator piston, the hydraulic control system being configured to regulate movement of the actuator piston from the activated to the deactivated positions such that the actuator piston presses against one of the ramped surfaces of the drive shaft and thereby changes the direction of the drill string.

* * * * *